US006199668B1

(12) United States Patent
Gorza et al.

(10) Patent No.: US 6,199,668 B1
(45) Date of Patent: Mar. 13, 2001

(54) DEVICE FOR REGENERATING A BRAKE PARTICULARLY FOR SKATES

(75) Inventors: Roberto Gorza, Feltre; Luca Bertolo, Treville Di Castelfranco Veneto, both of (IT)

(73) Assignee: Benetton Group S.p.A., Ponzano Veneto (IT)

( * ) Notice: Subject to any disclaimer, the term of this patent is extended or adjusted under 35 U.S.C. 154(b) by 0 days.

(21) Appl. No.: 09/225,235

(22) Filed: Jan. 4, 1999

(30) Foreign Application Priority Data

Jan. 9, 1998 (IT) ..... TV98A0001

(51) Int. Cl.[7] ..... B60T 1/14
(52) U.S. Cl. ..... 188/5; 188/32
(58) Field of Search ..... 188/5, 1.11 R, 188/32, 71.7, 71.8, 196 R, 4 R, 413, 24.12, 24.22, 28, 29, 11.1 W; 280/11.2, 11.21, 11.19, 11.22, 11.23, 11.27

(56) References Cited

U.S. PATENT DOCUMENTS 2,191,018 2/1940 Ickenroth .
5,052,701 * 10/1991 Olson ..... 280/11.2
5,375,859 * 12/1994 Peck et al. ..... 280/11.2
5,388,844 * 2/1995 Pellegrini, Jr. et al. ..... 280/11.2
5,465,984 * 11/1995 Pellegrini, Jr. et al. ..... 280/11.2
5,505,469 * 4/1996 Zorzi et al. ..... 280/11.2
5,570,759 * 11/1996 Zorzi ..... 188/5

FOREIGN PATENT DOCUMENTS

2122526 * 10/1995 (CA) .
0 687 487 12/1995 (EP) .
0928623 * 7/1999 (EP) .
97 03736 2/1997 (WO) .

* cited by examiner

*Primary Examiner*—Matthew C. Graham
*Assistant Examiner*—Melanie Talavera
(74) *Attorney, Agent, or Firm*—Guido Modiano; Albert Josif; Daniel O'Byrne

(57) ABSTRACT

A device for regenerating a brake, particularly for skates having a supporting frame for two or more wheels and a support for a pad which has an initially intact surface which interacts with the ground during braking. A sensor for detecting the degree of wear of the surface of the pad is associated with the support and is connected to a sprocket suitable to modify the initial position of the pad. Advantageously, this modification can be achieved by restoring an intact condition for the surface that interacts with the ground. The device allows to achieve optimum braking without requiring any intervention on the part of the user for pad replacement.

22 Claims, 5 Drawing Sheets

DEVICE FOR REGENERATING A BRAKE PARTICULARLY FOR SKATES

BACKGROUND OF THE INVENTION

The present invention relates to a device for regenerating a brake, particularly for skates.

The problem of achieving optimum braking is common to all currently conventional skates. In this regard, U.S. Pat. No. 337,161 discloses a skate which is provided with a shoe supporting plate having two lower supports for two pairs of mutually parallel wheels. A support for a brake is associated at the rear pair of wheels; the brake is constituted by a pad, having a surface which interacts with the ground and which is generally made of rubber-like material. The position of the pad can be adjusted by means of a screw which reduces the distance of the surface of the pad from the facing ground.

A drawback of this conventional type is that as the pad gradually wears, the user must remove the skate and operate the screw, pushing the pad so that it returns closer to the ground.

This operation must be repeated whenever required by the amount of wear of the pad. Moreover, the direct intervention of the user implies suspending the sports activity.

The need to restore the initial condition of the pad, and therefore its position with respect to the ground at a preset height, is in any case indispensable in order to ensure that the user achieves optimum braking.

U.S. Pat. No. 3,112,120 discloses a skate in which the threaded stem of a brake, provided with a pad towards the ground, is rotatably associated in the rear region of the shoe supporting plate, adjacent to the pair of rear wheels.

An adjustment washer is associated with the threaded stem; as in the previously illustrated case, during the use of the skate the pad wears at the region that interacts with the ground: as the thickness of the pad, and accordingly the distance of the pad from the ground, decreases, the user is forced to stop his other sports activity, optionally remove the skate to perform the operation more easily, and turn the pad so as to move it closer to the ground; the position can be determined by the adjustment washer.

The above skate also, however, suffers the above noted drawbacks.

U.S. Pat. No. 5,197,572 discloses a skate provided with a brake comprising a support for a pad.

The brake further comprises an element for fixing and adjusting the support which is accordingly connected between the wheel pivoting frame and the pad support.

Adjustment occurs by means of the interaction between two toothed surfaces formed on the pad support and on the support fixing and adjustment element. This position can be preset by means of a screw, thus allowing the user to move the pad closer to the ground whenever required by gradual wear.

However, this skate also suffers the above-mentioned drawbacks, since this adjustment must be performed by the user whenever he detects a decrease in the braking effect and because this adjustment must be performed by interrupting sports practice, optionally removing the skate and using suitable tools.

Variations are also provided in which the adjustment can occur by activating suitable nuts and lock nuts; this increases the difficulty of the operation.

U.S. Pat. No. 5,192,099 discloses a skate provided with a supporting frame for in-line wheels which has, at its rear end, two tabs for the pivoting of the last rear wheel; said tabs can move elastically closer to the overlying part of the frame when the user shifts his weight backward.

In this skate, the braking action is achieved because a pad is arranged transversely to the frame in the region above the last wheel and therefore interacts with the wheel when the skate is tilted backward.

In order to compensate for the wear of the pad, the pad is associated with a system for adjusting its vertical position which however, like the previously described skates, requires manual intervention of the user.

U.S. Pat. No. 5,348,320 discloses a skate which comprises a supporting frame for mutually in-line wheels, to the rear of which the support for a pad which interacts with the ground during braking is slidingly associated.

The connection between the wheel support and the pad support is adjustable, in that there is a screw whose tightening locks two complementarily toothed surfaces formed respectively on the pad support and on the wheel support.

However, this skate also suffers the same drawbacks noted in the previous skates.

SUMMARY OF THE INVENTION

The aim of the present invention is to solve the above-mentioned problems, eliminating the drawbacks of the cited prior art and thus providing an invention which allows the user to always achieve the braking action in optimum conditions even as the degree of wear of the braking element that interacts with the ground varies.

An important object is to provide an invention which allows to achieve, over time, a constantly optimum braking action without requiring the user to temporarily suspend sports practice or to intervene directly to restore the optimum conditions.

A further important object is to provide an invention which allows to keep the effectiveness of the braking action constant over time and to extend the life of the braking element.

A further object is to provide an invention which is reliable and safe in use and has low manufacturing costs.

This aim, these objects and others which will become apparent hereinafter are achieved by a device for regenerating a brake, particularly for skates comprising a supporting frame for a plurality of wheels, a pad or block being associated, in a rear region, with said frame, said pad having a surface which is initially intact and interacts with the ground during braking, characterized in that a sensor for detecting the degree of wear of said surface of said pad is connected to a means which is adapted to modify the initial position of said pad.

Advantageously, this modification of the initial position of said pad or block is achieved by restoring an intact condition for said surface that interacts with the ground.

BRIEF DESCRIPTION OF THE DRAWINGS

Further characteristics and advantages of the invention will become apparent from the following detailed description of two particular but not exclusive embodiments, illustrated only by way of non-limitative example in the accompanying drawings, wherein.

DESCRIPTION OF THE PREFERRED EMBODIMENTS

Figure 1:
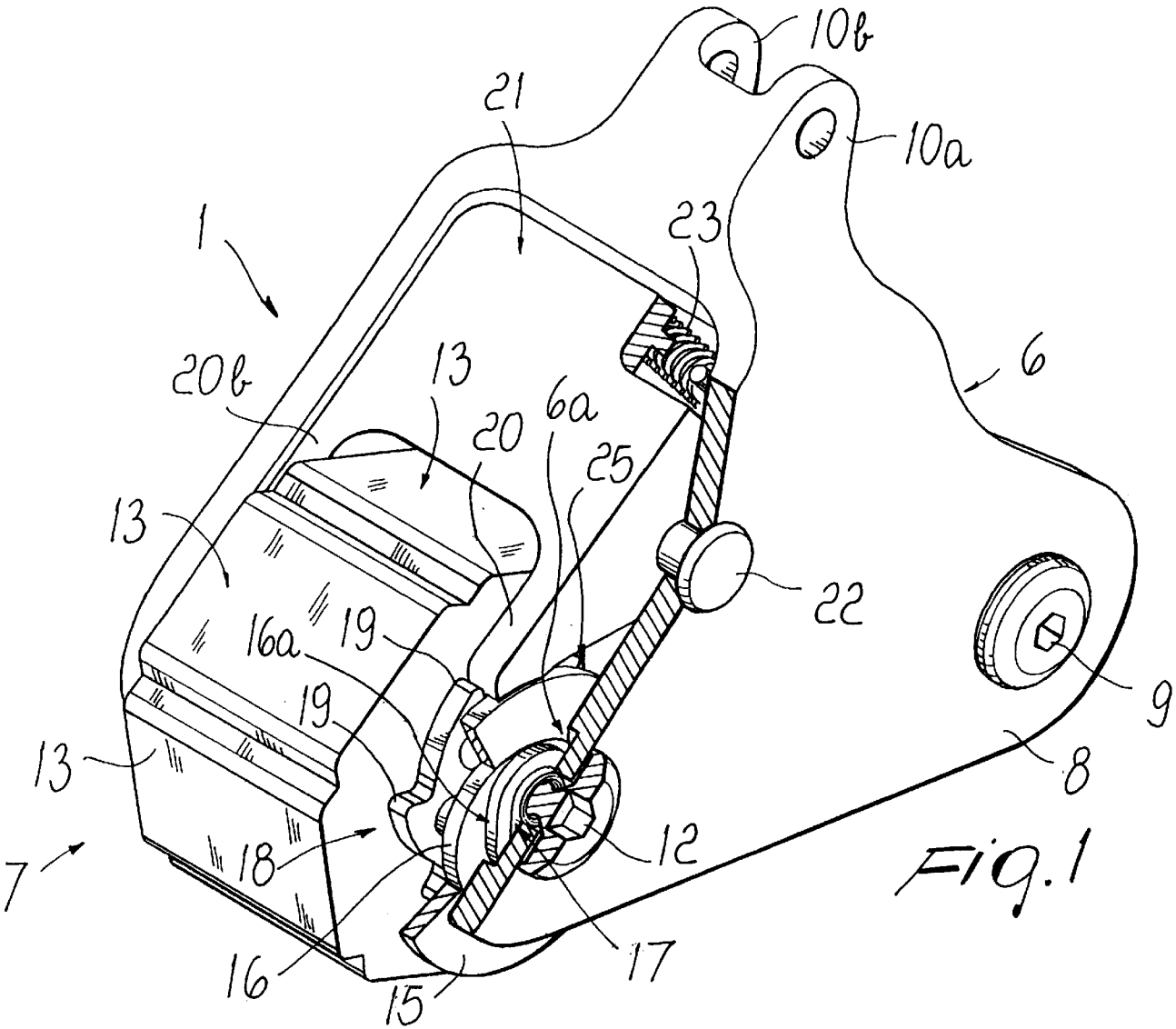
FIG. 1 is a partially sectional side perspective view of the device.

With reference to the above FIG. 1 designates the device, which is particularly usable for skates of the type comprising a shoe 2 below which a preferably U-shaped frame 3 is associated. A plurality of mutually in-line wheels 5 are pivoted between the first wings 4 of said frame.

A support 6 for a pad or block 7 is associated at the rear end of the frame 3 and has a box-like shape which forms a pair of second wings 8 which are pivoted, at one end, at the first pivot 9 for supporting the last wheel 5 of the skate.

Toward the shoe 2, the support 6 has a pair of third wings 10*a*, 10*b* which are associated with the shoe or with a tab which protrudes from the frame by means of a suitable second pivot 11.

The pad or block 7 is pivoted between the second wings 8 of the support 6, in a region to the rear of the last rear wheel 5, by means of a suitable third pivot or screw 12 with respect whereto the pad or block can turn.

The pad or block has a polygonal plan shape and therefore has a plurality of preferably flat surfaces 13 which are adapted to interact with the ground 14.

A sensor for detecting the degree of wear of each one of the surfaces 13 is associated with the support 6 and is constituted by a disk 15 which is arranged coaxially to the third pivot or screw 12 at at least one side of the pad or block 7.

The disk 15 has an essentially annular shape, with a central hole whose diameter is several times larger than the diameter of the third pivot or screw 12. A body 16 can be arranged in the hole and is provided with a protrusion or raised portion 16*a* which is rigidly coupled to said body and in which there is a slot 17 in which said third pivot or screw 12 passes.

Figure 2:
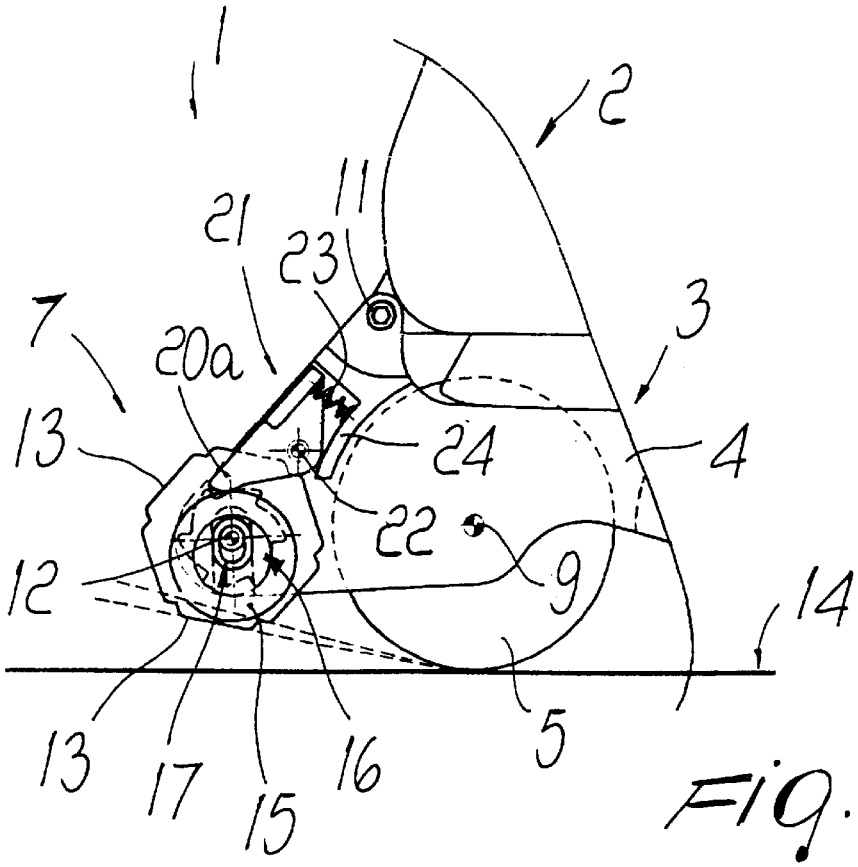
FIG. 2 is a partially cutout side view of the device in the optimum braking conditions.
Figure 4:
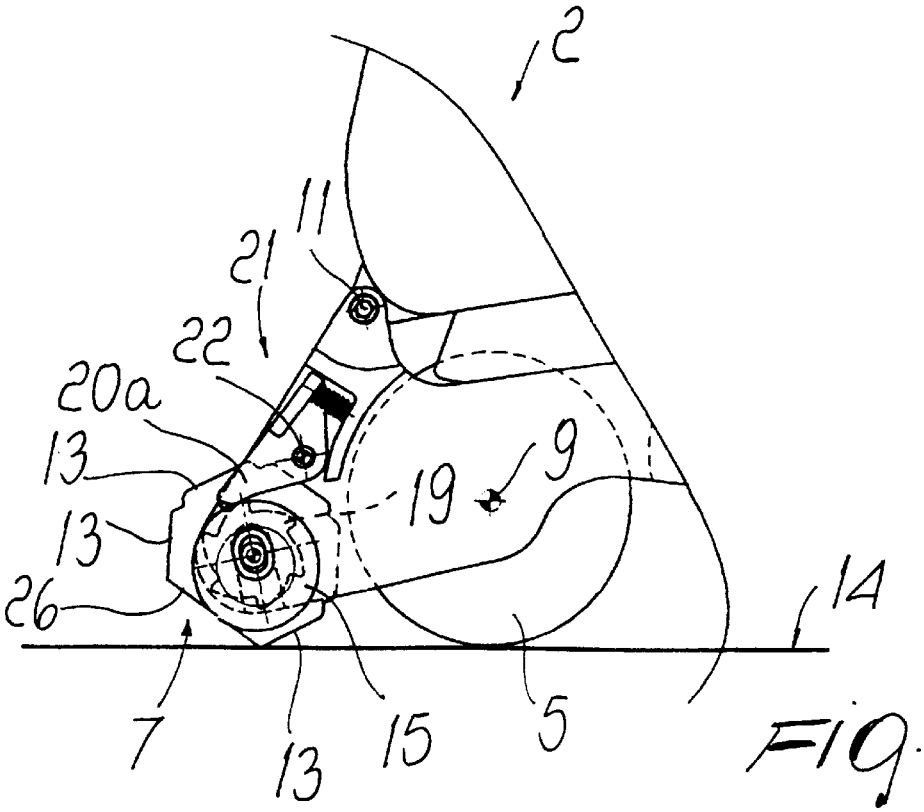
FIG. 4 is a view, similar to FIG. 3, of an intermediate step of the activation of the device.

Slot 17 is essentially vertical with respect to the ground 14 in the condition in which the braking action is not activated, as shown in FIG. 2, while the raised portion 16*a* is accommodated within a recessed seat 6*a* formed inside the support 6. This refinement allows the body 16 to slide exclusively in a vertical direction with respect to the support 6, since rotation is locked by the interaction between the raised portion 16*a* and the walls of the recessed seat 6*a*.

The body 16 and the disk 15 are therefore approximately adjacent to the internal lateral surface of the second wings 8 of the support 6. A sprocket 18 is arranged on the opposite side with respect to said body and said disk, rotates rigidly with the pad or block 7 and has a plurality of teeth 19 which selectively interact by abutment with a pair of tabs 20*a* and 20*b* which protrude from a pawl 21 which is rotatably associated between the shoulders 8 by means of a fourth pivot 22 and oscillates in contrast with a flexible element such as a spring 23 which is interposed between said pawl and a base 24 located inside said support 6 in a region above the adjacent wheel 5.

The ends of the tabs 20*a* and 20*b*, in addition to interacting with the teeth 19 of the sprocket 18, partially rest at the outer perimetric edge 25 of the body 16, as shown in FIG. 1.

The arrangement of the teeth is such as to block a clockwise rotation of the pad 7 during the normal braking action and therefore when the surface that interacts with the ground is not worn.

The configuration of said disk 15, said body 16, said slot 17, said sprocket 18, said teeth 19 and said tabs 20*a* and 20*b* is such that they are not actively involved during braking in the condition in which the surface 13 that interacts with the ground is not worn beyond a certain threshold.

Figure 3:
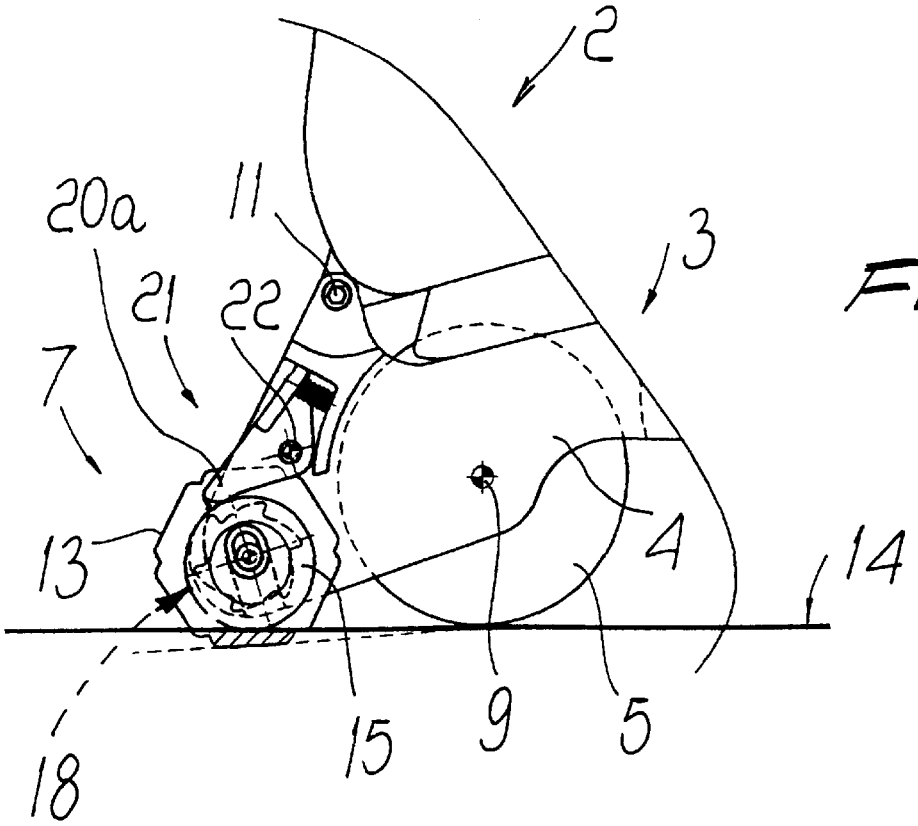
FIG. 3 is a view, similar to FIG. 2, of the device in the condition in which the surface of the pad that interacts with the ground is worn to the point of activating the sensor.

Once said threshold, shown in FIG. 3, has been reached, during braking each one of the disks 15 interacts with the ground, and as the surface of the pad wears, the disk 15 and the body 16 provided with the slot 17 simultaneously move vertically.

Because of said slot, the disk 15, by lifting, forces the disengagement of the end of the tabs 20*a* and 20*b* from the respective engagement tooth 19 until the condition shown in FIG. 3 is achieved.

Figure 5:
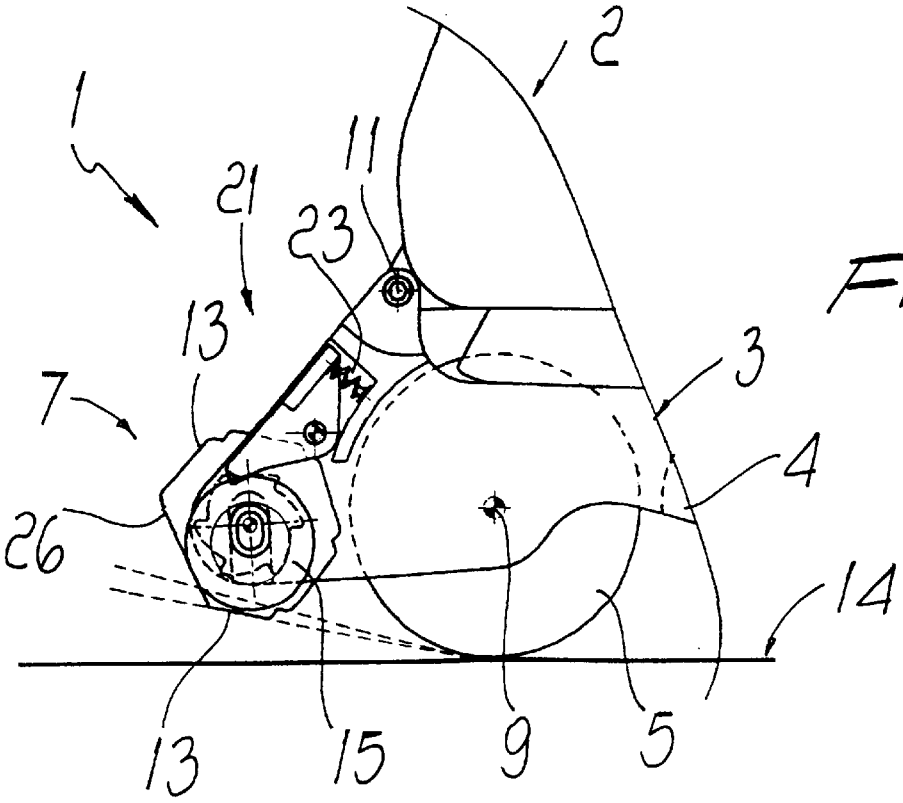
FIG. 5 is a view, similar to FIG. 4, of the condition in which optimum braking conditions are restored.
Figure 6:
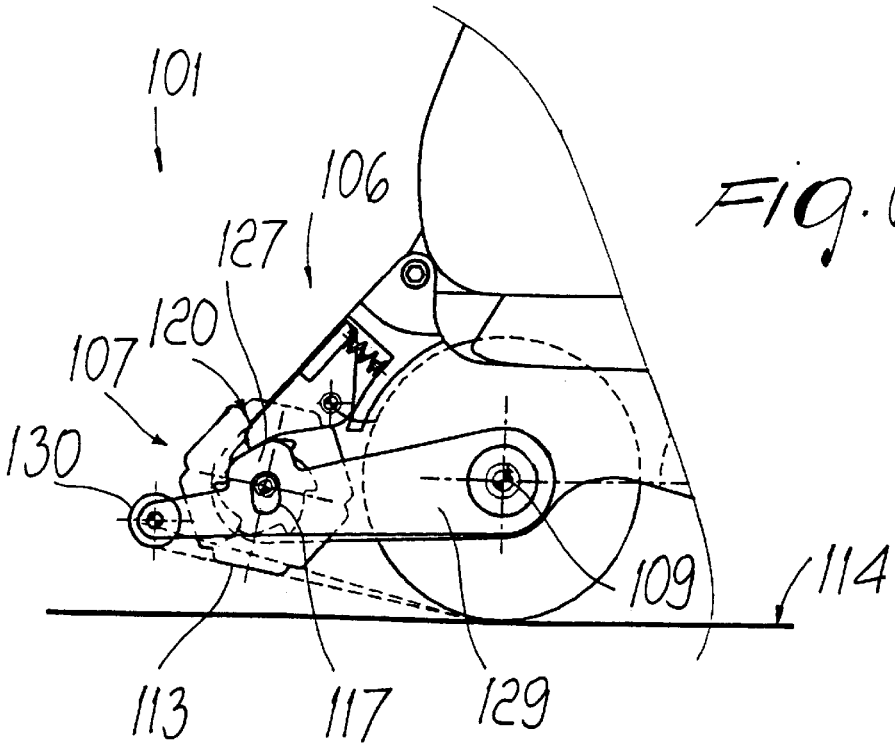
FIGS. 6, 7, 8 and 9 are views, similar to FIGS. 2, 3, 4 and 5, of another embodiment.
Figure 7:
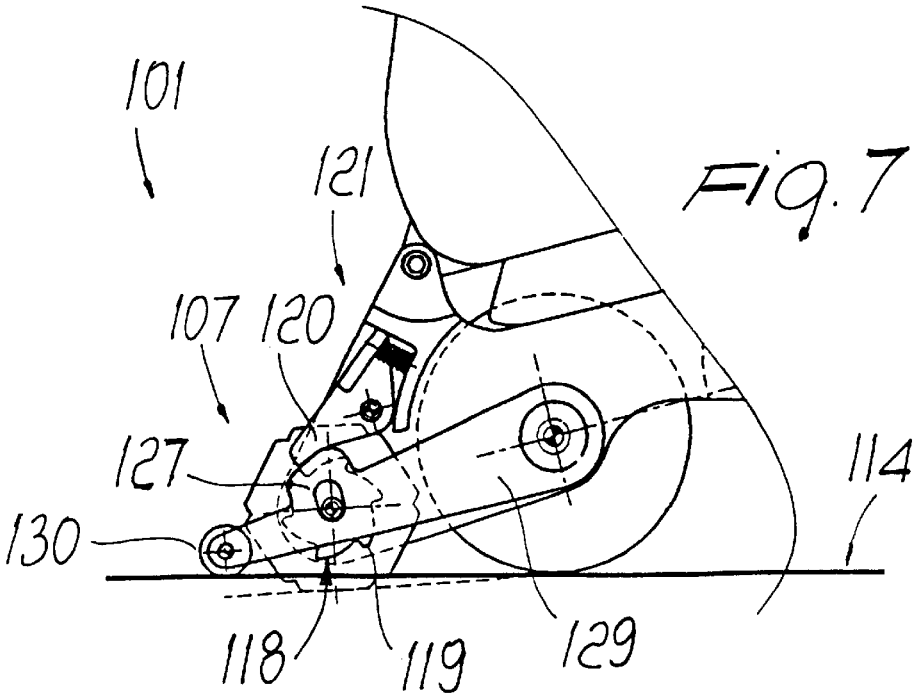
Figure 8:
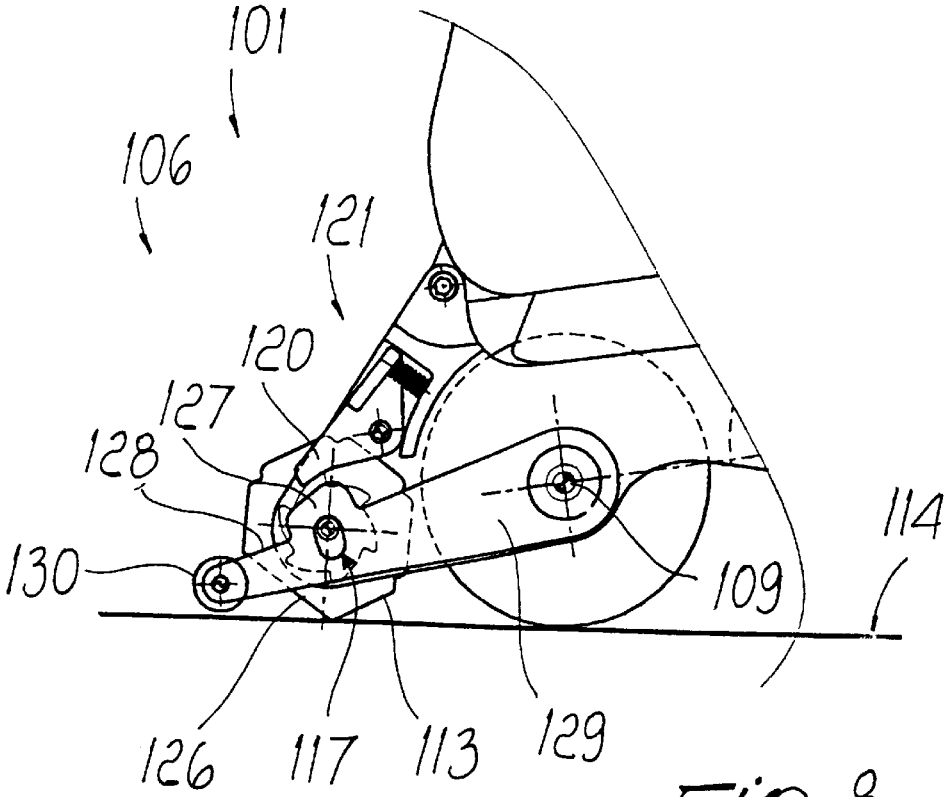
Figure 9:
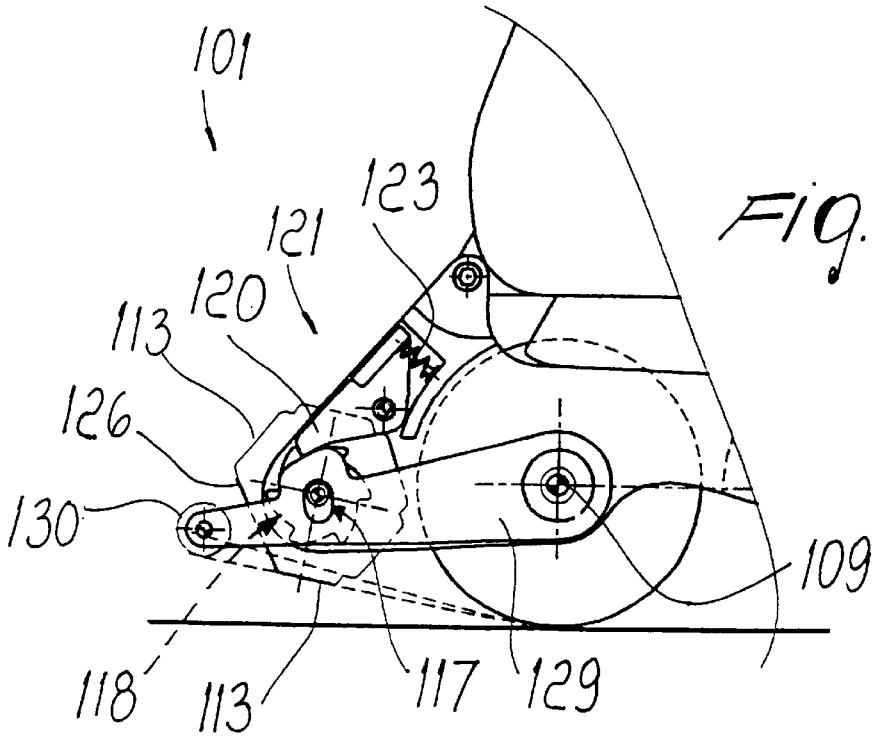

In this condition, the disk has disengaged the ends of the tabs 20*a* and 20*b* from the respective tooth 19, thus allowing the free clockwise rotation of the pad 7 until, as shown in FIG. 5, the worn surface 26 of the pad 7 is turned through an angle which again directs toward the ground 14 a further intact surface 13. In this condition, because of the spring 23, the ends of the tabs 20*a* and 20*b* reengage a corresponding tooth 19.

This new repositioning is allowed by the fact that the pawl 21 forces the disk to reposition itself in the initial condition, since the new surface 13 that interacts with the ground has once again a preset height, so as to restore the conditions shown in FIG. 2.

It has thus been observed that the invention has achieved the intended aim and objects, a device having been provided which allows, in a fully automatic manner and therefore sparing the user from any action, to always achieve an optimum braking condition, since as the surface that was initially termed intact and interacts with the ground wears, the pad rotates, restoring the initial optimum conditions, presenting again a new intact surface which makes contact with the ground.

The invention further allows a longer life of the pad, since all the surfaces formed thereon are utilized before considering its replacement.

A decrease in the degree of inclination of the skate that determines the braking action when a certain degree of wear of the pad is exceeded is also noted.

The device according to the invention is susceptible of modifications and variations, within the scope of the same inventive concept as claimed.

Thus, for example, FIGS. 6 to 9 illustrate another embodiment of a device 101 in which the tabs 120 of the pawl 121 are lifted by means of a cam 127 which protrudes at the upper perimetric edge 128 of two fourth wings 129 which are arranged laterally to the support 106 and are freely pivoted, at one end, at the first pivot 109 and are transversely connected, at the other end, by a suitable sensor which is constituted by a roller 130 which is freely rotatably pivoted between them and interacts with the ground 114.

The cam 127 is formed at the region that lies above a slot 117 formed in said fourth wings 129.

When using this embodiment, if an intact surface 113 of the pad or block 107 wears out, the fourth wings 129 rotate and the cam 127 accordingly rises due to the contact of the roller 130 with the ground; the movement of the cam 127 forces the tabs 120 of the pawl 121 to disengage from the respective tooth 119 of the sprocket 118, thus allowing said pad 107 to turn clockwise.

In this manner, the worn surface 126 of said pad rotates, repositioning at the underlying ground 114 a new intact surface 113, the different height of which allows the pawl 121 to again mesh with one of the teeth 119, which is forced to do so by the presence of the spring 123.

This embodiment also allows to achieve the intended aim and objects.

The materials and the dimensions that constitute the individual components of the invention may of course be the most pertinent according to specific requirements.

The disclosures in Italian Patent Application No. TV98A000001 from which this application claims priority are incorporated herein by reference.

What is claimed is:

1. A device for regenerating a brake, particularly for skates comprising a supporting frame for a plurality of wheels, a pad or block being associated, in a rear region, with said frame, said pad having a surface which is initially intact and interacts with the ground during braking, wherein a sensor for detecting the degree of wear of said surface of said pad is connected to a means which is suitable to automatically modify the initial position of said pad in response to said sensor.

2. The device of claim 1, wherein said means adapted to modify the initial position of said pad restores an intact condition for said surface that interacts with the ground.

3. The device of claim 1, wherein said pad comprises a plurality of braking surfaces, and wherein said means adapted to modify the initial position of said pad comprises elements for temporarily locking the position of a selected one of said plurality of braking surfaces of said pad.

4. The device of claim 1, wherein the change in the position of said pad occurs by means of the friction of the surface of said pad that interacts with the ground.

5. The device of claim 1, wherein the change in the position of said pad occurs by means of an actuator which is actuated directly or by means of said sensor.

6. The device of claim 1, wherein said sensor causes the change of the position of said pad when a preset wear threshold of the surface of said pad that interacts with the ground is exceeded.

7. The device of claim 1, particularly usable for skates of the type that comprise a U-shaped frame having a plurality of mutually in-line wheels being pivoted between first wings of said frame, a support for said pad being associated at the rear end of said frame and having a box-like configuration which forms a pair of second wings which are pivoted, at one end, at a first pivot for the last wheel of the skate, said support having a pair of third wings which are associated with a tab which protrudes from said frame by means of a second pivot, wherein said pad is pivoted between said first wings of said support in a region located to the rear of the last rear wheel by means of a third pivot with respect to which said pad can rotate, said pad having a polygonal shape in plan view, so as to form a plurality of contiguous surfaces which are suitable to interact individually with the ground.

8. The device of claim 7, wherein a sensor for detecting the degree of wear of said surface that interacts with the ground is associated with said support, said sensor being constituted by at least one disk which is arranged coaxially to said third pivot at one side of said pad.

9. The device of claim 8, wherein said disk has an essentially annular shape, with a central hole whose diameter is several times larger than the diameter of said third pivot, a body provided with a slot in which said third pivot passes being arrangeable within said hole.

10. The device of claim 9, wherein said slot is arranged essentially vertically with respect to the ground in the condition in which the braking action is not activated.

11. The device of claim 10, wherein said body and said disk are approximately adjacent to the inner lateral surface of said second wings of said support, at least one sprocket being arranged on the opposite side with respect to said body and said disk and being able to rotate rigidly with said pad, said sprocket having a plurality of teeth which selectively interact by abutment with tabs which protrude from a pawl which is rotatably associated between said shoulders by means of a fourth pivot and oscillates in contrast with a flexible element, such as a spring which is interposed between said pawl and a base arranged inside said support in a region that lies above the adjacent wheel.

12. The device of claim 11, wherein the ends of said tabs interact with said teeth of said sprocket and rest partially at the outer perimetric edge of said body.

13. The device of claim 12, wherein the arrangement of said teeth is such as to block a clockwise rotation of said pad during normal braking and therefore when the surface that interacts with the ground is not worn.

14. The device of claim 11, wherein the configuration of said disk, said body, said slot, said sprocket, said teeth and said tabs is such 'that they are not actively involved during braking in the condition in which the surface of said pad that interacts with the ground is not worn beyond a certain threshold.

15. The device of claim 14, wherein, once said threshold has been reached, during braking said at least one disk interacts with the ground and, as said surface of said pad wears, there is a simultaneous vertical movement of said disk and of said body provided with said slot, so as to force the disengagement of the end of said tabs from the respective engagement tooth, so as to allow the free clockwise rotation of said pad and therefore of said worn surface until another intact surface is arranged toward the ground, the ends of said tabs reengaging, in this condition, one of said teeth by means of said spring.

16. The device of claim 11, comprising at least one cam which protrudes at the upper perimetric edge of a pair of fourth wings which are arranged laterally to said support and are freely pivoted, at one end, at said first pivot and are transversely connected, at their other end, by a suitable sensor which is constituted by a roller which is pivoted between them so as to be able to rotate freely and interacts with the ground, said at least one cam being adapted to allow the lifting of said tabs of said pawl.

17. The device of claim 16, wherein said cam is formed at the region that lies above a slot formed in said fourth wings.

18. The device of claim 17, wherein, if said surface of said pad is worn, said fourth wings rotate, lifting said at least one cam, which forces said tabs of said pawl to disengage from the respective tooth of said sprocket, so as to allow said pad to perform a clockwise rotation and therefore allow the worn surface thereof to rotate until a new intact surface is again arranged at the underlying ground, the different height of said new surface allowing said pawl to engage again one of said teeth, which is forced to do so by said spring.

19. The device of claim 10, wherein said body is provided with a protrusion or raised portion which is rigidly coupled thereto and in which said slot is formed, said protrusion or raised portion being accommodated within a recessed seat which is formed inside said support and allows only a vertical sliding.

20. A device for regenerating a brake, in a skate comprising a supporting frame for a plurality of wheels, the device comprising a pad or block being associated, in a rear region, with said frame, said pad having a surface which is initially intact and interacts with the ground during braking, wherein a sensor for detecting the degree of wear of said surface of said pad is connected to a modification device which is suitable to automatically modify the initial position of said pad in response to said sensor.

21. A device according to claim 20, wherein said pad comprises a plurality of braking surfaces, and wherein said modification device adapted to modify the initial position of said pad comprises elements for temporarily locking the position of a selected one of said plurality of braking surfaces of said pad.

22. A device according to claim 21, wherein said pad is rotatably connected to a block about a rotation axis for said pad, said plurality of braking surfaces of said pad extending circumferentially about said rotation axis for said pad.

* * * * *